United States Patent [19]

Strauss

[11] 4,095,834

[45] Jun. 20, 1978

[54] SELF-ATTACHING LIFTING DEVICE

[76] Inventor: Richard H. Strauss, 4364 Daisy St., Springfield, Oreg. 97477

[21] Appl. No.: 749,046

[22] Filed: Dec. 9, 1976

[51] Int. Cl.[2] ..... B66C 1/44

[52] U.S. Cl. ..... 294/97

[58] Field of Search ..... 294/97, 106, 115, 113, 294/118, 93

[56] References Cited

U.S. PATENT DOCUMENTS 2,879,101 3/1959 Daroci ..... 294/97

2,951,725 9/1960 St. Jean ..... 294/97

*Primary Examiner*—James B. Marbert

*Attorney, Agent, or Firm*—James D. Givnan, Jr.

[57] ABSTRACT

A lifting device having radially disposed arms each provided with a lift pad assembly pivotally mounted at the outer arm ends. The arms are pivotally attached at their inner ends to a central post structure. An arm locking assembly includes a sleeve on the post structure having pivoted links coupled to each of the arms to assure uniform locking and unlocking of the arms.

5 Claims, 4 Drawing Figures

SELF-ATTACHING LIFTING DEVICE

BACKGROUND OF THE INVENTION

The present invention concerns devices for temporary attachment to loads for imparting lifting movement thereto and particularly to a lift device for frictional engagement with an inner wall surface of the load.

The concept of providing extensible load lifting devices engagable with load wall surfaces is disclosed in the prior art. Generally speaking, such devices utilize complex linkages which enable radial extension or adjustment of the linkages to effect load engagement. The foregoing coupled with the human factor renders the prior art devices susceptible to malfunction and accident load disengagement. If the loads lifted with such devices are sizable, as is usually the case, accidental loss of a load can result in substantial damage and severe injury in addition to possible destruction of the article lifted.

SUMMARY OF THE PRESENT INVENTION

The present invention is embodied within a self-attaching lifting device readily engagable with a load without adjustment of components.

A centrally disposed mast is adapted to be carried by a lift instrumentality, such as a lift cable; and swingably mounts adjacent its lower end a series of radially disposed arms. Each of the arms is provided with a lift pad assembly pivotally coupled to the outer arm end. Each lift pad assembly is provided with friction means for biased engagement with an inner wall surface of the article being lifted. Additionally, each pad assembly includes a pad positioning lip engagable with the upper perimeter of the load. Slidably disposed on said mast is a lock assembly including linkages pivotally coupled with said radially disposed arms to retain same against displacement during lifting of the load. The radially disposed arms pivot during attachment of the device to the load thereby permitting passage of the mast lower end into the interior area defined by the load with subsequent upward mast movement increasing the effective arm length to cause lift pad-load engagement.

Important objects of the invention include: the provision of a lifting device automatically attachable to a load; the provision of a lifting device having radially projecting arms each provided with a pivotally mounted lift pad assembly engagable with the load upon lifting motion being imparted to the device; the provision of a lifting device including an arm locking assembly with linkages confining each of said radially extending arms against movement during transport of the load; the provision of a lifting device of relatively uncomplicated design with few components to provide high reliability.

DETAILED DESCRIPTION OF THE PREFERRED EMBODIMENT

Figures 1, 2, 3, 4:
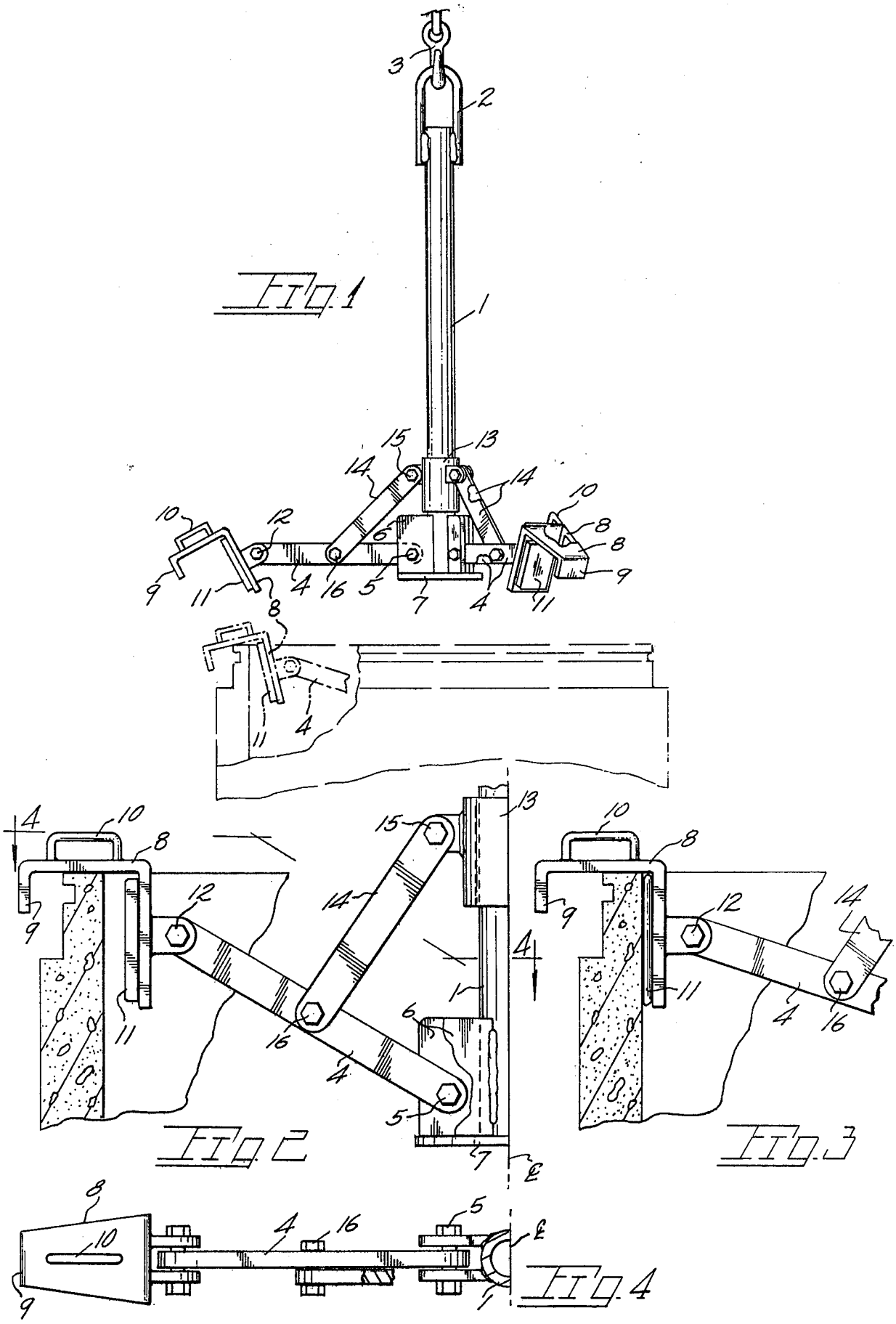
FIG. 1 is a side elevational view of the present lifting device with a load to be lifted shown in phantom lines.
FIG. 2 is a fragmentarily elevational view of the device with an arm thereof shown prior to upward movement being imparted to the lifting device.
FIG. 3 is a view similar to FIG. 2 but with the arm elevated and extended resulting in lift pad-load contact.
FIG. 4 is a sectional plan view taken downwardly along line 4—4 of FIG. 2.

With continuing attention to the accompanying drawing wherein applied reference numerals indicate parts similarly identified in the following description, the reference numeral 1 indicates a post structure or mast adapted at its upper end as by an eye 2 to receive a hook 3 or other lifting instrumentality.

A series of arms at 4 extend radially outward from the mast lower end with a fixed axis, pivotal connection 5 provided by fastener assemblies extending through the arm ends and paired post welded flanges 6. A circular base plate is indicated at 7. From the foregoing it will be seen that arms 4 may move vertically within true radial planes common to the axis of post structure 1.

Carried at the outer end of each arm 4 is a lift pad assembly 8 including a depending lip portion 9 and a hand hold 10. A resilient friction member 11 is suitably secured to an upright surface of the lift pad assembly.

Importantly an outer, single axis pivotal connection is provided at 12 joining each pad assembly to an arm's outer end which permits the lift pad assembly to depend from the arm end in a gravitationally canted manner as shown in the full line position of FIG. 1. The single axis pivotal connection 12, as well as the other pivotal connections of the present device, may be nut and bolt assemblies preferably of the self-locking type.

An arm locking assembly includes a sleeve 13 positionable along mast 1 and having depending links at 14. Fastener assemblies at 15 and 16 couple the upper and lower ends of the links to sleeve 13 and arms 4 respectively. Accordingly, arm locking assembly 13 serves to interconnect the arms 4 thereby assuring synchronous vertical arm movement.

In operation, the device is suspended from a lifting instrumentality which also serves to lower the device into article engagement. From the full line position shown in FIG. 1, lowering of the device will result in each lift pad assembly contacting the upper perimeter of the article with further lowering of the device permitted by arms 4 moving downwardly as per the broken line position of FIG. 1. Such movement is permitted by the pivotal connection at 5 and 12 and by the inward movement of the lift pad assembly as limited by the lip 9 thereon. Upon each lift pad assembly coming to rest on the upper perimeter of the article, as shown in an exemplary manner in FIG. 2, post structure 1 is lifted to effectively increase the arm length as each of said arms move toward the horizontal. As shown in FIG. 3, prior to reaching the horizontal the outer end of arm 4 will move outwardly to bias the lift pad assembly into load contact with lifting forces biasing the resilient member 11 into positive load engagement. Accidental release of the load resulting from retraction of a single arm 4 is prevented by locking assembly 13 which, as earlier mentioned, interconnects each of said arms to prevent independent movement.

At the discharge site, the load is deposited onto a ground surface with continued downward movement of post structure 1 causing the arms 4 to retract somewhat to the FIG. 2 position. During load discharge, grasping of one hand hold 10 to prevent outward lift pad assembly movement during subsequent lifting of the unloaded device will also assure non-engagement of the other lift pad assemblies with the article wall surface, such being accomplished by the interconnecting arm locking assembly.

While I have shown but one embodiment of the invention it will be apparent to those skilled in the art that the invention may be embodied still otherwise without departing from the spirit and scope of the invention claimed.

Having thus described the invention what is desired to be secured under a Letters Patent is:

1. A lifting device for automatic load attachment by a lifting instrumentality to loads having an inner wall surface, said device comprising, a centrally disposed post structure adapted at its upper end for attachment to a lift line of the instrumentality, arms pivotally attached on a fixed axis to the post structure and normally extending outwardly therefrom in a radial manner, an arm locking assembly on said post structure including arm attached links, a load engaging pad assembly carried by each of said arms, each pad assembly being of angular configuration and thereby adapted for initial rested engagement with the upper edge of the load to be lifted, and single axis pivot means interconnecting each pad assembly to its arm to permit free rotational movement between each arm and pad assembly during load attachment whereby the arms, subsequent to pad assembly contact with the load upper edge, may swing downwardly to enter that area defined by said inner wall surface of the load with the effective arm length, during subsequent upward movement of the post structure, being increased so as to assure positive pad assembly-load engagement during lifting.

2. The lifting device claimed in claim 1 wherein said arm locking assembly additionally includes a sleeve slidably mounted on said post structure, said links pivotally attached at their upper ends to said sleeve whereby downward and upward arm movement is synchronized.

3. The lifting device claimed in claim 2 wherein each angular pad assembly additionally includes a downwardly extending lip member adapted for retentive engagement with an outer wall surface of the load during lowering of the device for load engagement.

4. The lifting device claimed in claim 1 wherein each pad assembly includes a resilient member for biased, compressed contact with the inner wall surface of the load.

5. The lifting device claimed in claim 4 wherein said centrally disposed post structure simultaneously repositions outwardly each of said arms during upward post movement to assure pad assembly-wall surface engagement and centering of the post structure within the load.

* * * * *